US005630462A

United States Patent [19]

Landua et al.

[11] Patent Number: 5,630,462

[45] Date of Patent: May 20, 1997

[54] DEVICE FOR FILLING SHOOTING HEADS

[75] Inventors: Werner Landua, Mannheim; Werner Pichler, Brühl, both of Germany

[73] Assignee: Adolf Hottinger Maschinenbau GmbH, Mannheim, Germany

[21] Appl. No.: 624,451

[22] PCT Filed: Oct. 6, 1994

[86] PCT No.: PCT/DE94/01171

§ 371 Date: Apr. 4, 1996

§ 102(e) Date: Apr. 4, 1996

[87] PCT Pub. No.: WO95/09706

PCT Pub. Date: Apr. 13, 1995

[30] Foreign Application Priority Data

Oct. 7, 1993 [DE] Germany ..... 4334117.9

[51] Int. Cl.[6] ..... B22C 13/12; B22C 15/24; B22C 19/04

[52] U.S. Cl. ..... 164/151.2; 164/155.2; 164/200; 164/456

[58] Field of Search ..... 164/200, 201, 164/202, 150.1, 151.2, 155.2, 4.1, 456, 19, 20, 21, 22

[56] References Cited

FOREIGN PATENT DOCUMENTS

| | | | |
|---|---|---|---|
| 0482458 | 4/1992 | European Pat. Off. . | |
| 4128952 | 7/1992 | Germany . | |
| 45-12843 | 5/1970 | Japan | 164/155.2 |
| 368903 | 6/1963 | Switzerland . | |
| 257791 | 11/1969 | U.S.S.R. | 164/456 |

*Primary Examiner*—J. Reed Batten, Jr.
*Attorney, Agent, or Firm*—Bell, Seltzer, Park & Gibson, P.A.

[57] ABSTRACT

A device for filling shooting heads (1) with molding materials (2), the device being provided with a filling assembly (6) that comprises a storage hopper (3) for the molding material (2), an outlet member (4) for discharging the molding material (2) into the shooting head (1), and a gate (5) for closing the outlet member (4). The filling assembly (6) being mounted on a machine frame (7) for vertical movement, so as to immerse the outlet member (4) into the shooting head (1), and it is constructed for filling the shooting head (1) in an exact, reproducible manner. For this purpose a noncontacting sensor (8) is mounted to the outlet member (4), the sensor (8) being directed into the shooting head (1) so as to detect therein the filling level.

6 Claims, 1 Drawing Sheet

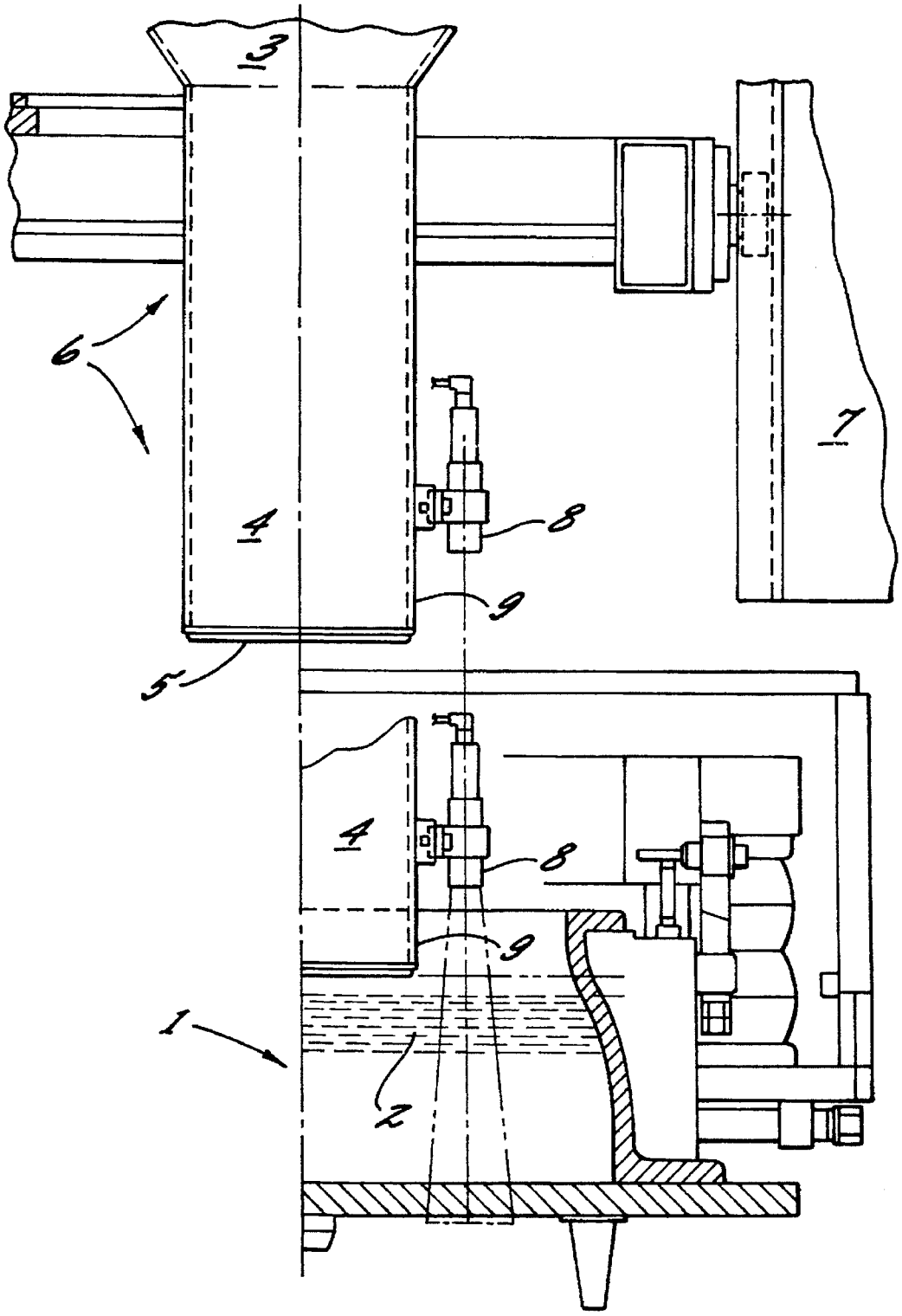
3
6
7
4
8
9
5
4
8
9
1
2

DEVICE FOR FILLING SHOOTING HEADS

BACKGROUND OF THE INVENTION

The invention relates to a device for filling shooting heads with molding materials, the device being provided with a filling assembly that comprises a storage hopper for the molding material, an outlet member for discharging the molding material into the shooting head, and a gate for closing the outlet member, the filling assembly being mounted on a machine frame for vertical movement so as to immerse the outlet member into the shooting head to be filled.

In the foundry practice, core shooting machines have been known for many years. For casting molded products, the foundry cores or molds are made in most cases as separate parts. They are combined and joined to each other to form a casting mold. Essential components of the core shooting machines are the so-called shooting heads with shooting plates accommodating the shooting nozzles. Molding sand, in particular core sand, i.e., a quartz sand previously compounded or coated with binding agents is supplied to the shooting heads under discussion, from which it is blown or shot under a very high air pressure into the respective molds through the nozzles arranged in the shooting plate.

Known from DE 41 28 952 C1 is a device of this type, which has however turned out to be problematic in practice to the extent that the filling device or the outlet pipe is immersed into the shooting head for filling same, regardless of the actual filling level of the shooting head. For example, if a shooting head is not properly emptied as a result of the shooting operation—for example, because of clogged shooting nozzles—or if the filling device has received too little molding material in a preceding filling process, molding material will be again supplied to the shooting head, regardless of the actual filling level therein. In any case, the known device does not allow, on the one hand, to take account of the actual filling level of the shooting head being filled, and, on the other hand, to fill the shooting head in a reproducible manner, while considering the filling level situation in the shooting head.

It is therefore the object of the present invention to improve and further develop a device for filling shooting heads of the type under discussion, so as to enable a reproducible filling of the shooting head with simple constructional means, while taking account of the actual filling level of the shooting head.

SUMMARY OF THE INVENTION

The above and other objects and advantages of the present invention are achieved by the provision of a device for filling a shooting head with molding material, which includes a filling assembly comprising a storage hopper for the molding material, an outlet member for discharging the molding material into the shooting head, and a gate for closing the outlet member. The filling assembly is mounted on a machine frame for vertical movement so as to immerse the outlet member into the shooting head. Also, the present invention further comprises a noncontacting sensor which is associated with the outlet member and directed into the shooting head so as to detect the level of the molding material therein.

In accordance with the invention, it has initially been recognized that a reproducible, exact filling of the shooting head is possible only, when the filling occurs with regard to the actual situation of the filling level within the shooting head. By means of the sensor as described above, it is easy to detect, whether or not the shooting head operates in a proper manner, namely, whether it delivers the correct quantity of molding material for each shooting operation. In any case, the device of the present invention allows to fill a shooting head while taking account of the actual filling level, so that with a corresponding adjustment it is always possible to adjust a predeterminable filling level within the shooting head.

As regards the type of sensor and with regard to commonly used molding materials, it is especially advantageous to use an ultrasonic sensor, which is capable of detecting the presence of molding material within the shooting head, i.e. its filling level, irrespective of the composition of the material.

With respect to a mounting of the sensor, it is advantageous to position the sensor in the lower region of the outlet member, above the gate. More specifically, the sensor could be mounted on the outside wall of the outlet member, the latter being itself constructed as a tubular extension of a funnel-shaped storage hopper. At least, it is necessary to ensure that the sensor does not interfere with a movement of the outlet member within the shooting head, so that for purposes of preventing any obstructions, it would be possible to mount the sensor in a further advantageous manner above the maximum depth of immersion of the outlet member. This would preclude in any case an interference with the movement of the outlet member.

Within the scope of a fully automated filling of the shooting head, it would further be of advantage, if the filling of the shooting head and, thus, the opening and closing of the gate were controllable via a signal of the sensor. If the sensor detected an inadequate filling level, the gate would be opened, so as to let in additional molding material. Once the attempted filling level is reached, the gate will close again as a result of a signal received from the sensor, so as to discontinue the further flow of molding material into the shooting head. After flattening in a manner known per se the surface of the molding material contained in the shooting head, the result of a new detection by the sensor may require a further refilling in accordance with the foregoing description.

Likewise, it would be possible that with a predeterminable immersion depth of the outlet member, the sensor supplies a signal for closing the gate upon detection of the filling level that can likewise be predetermined and corresponds maximally to the depth of immersion. Also in this instance, the molding material still being in the shooting head is considered.

There exist various possibilities of perfecting and further developing the teaching of the present invention in advantageous manner. To this end, reference may be made to the following description of an embodiment of the invention with reference to the drawing. In conjunction with the description of the preferred embodiment of the invention with reference to the drawing, also generally preferred embodiments and further developments of the teaching are described in more detail. In the drawing, the only Figure is a schematic view of an embodiment of the device in accordance with the invention for filling shooting heads, the outlet member being shown in an upper position and in a lower position immersed into the shooting head, and carrying a sensor for detecting the filling level.

DETAILED DESCRIPTION OF THE PREFERRED EMBODIMENT

Illustrated in the only Figure is a device for filling shooting head 1 with molding material 2. This device is provided with a filling assembly 6 comprising a storage hopper 3 for molding material 2, an outlet member 4 for discharging the molding material 2 into the shooting head 1, and a gate 5 for closing outlet member 4. For purposes of immersing the outlet member 4 into the shooting head 1 that is to be filled, the filling assembly 6 is mounted for vertical movement on a machine frame only indicated at 7.

In a manner as provided by the present invention, a noncontacting sensor 8 is mounted on the outlet member 4 and is directed into the shooting head 1 for detecting the filling level therein. This sensor 8 is activated only, when the filling level in shooting head 1 is to be determined, or when the information about the filling level in shooting head 1 is needed before and/or during the filling of the shooting head 1.

The sensor 8 that is provided to this end, is constructed as an ultrasonic sensor. It is mounted on the lower region of outlet member 4, the sensor 8 being actually mounted on the outside wall 9 of outlet member 4 that is made tubular in this instance. The height of sensor 8 is defined in this embodiment such that, as outlet member 4 immerses into the shooting head 1, its movement is not hindered, thereby preventing the sensor 8 from being damaged.

With respect to controlling the gate 5 by a possibly prepared signal of the sensor, in particular when the depth of immersion of outlet member 4 and the filling level in the shooting head 1 are predeterminable, the general part of the description is herewith incorporated by reference for purposes of avoiding repetitions.

Finally, it should be pointed out in particular that the device of the present invention enables a reproducible, exact filling of the shooting head. Thus, an unsatisfactory accumulation of the molding material inside the shooting head or an unintentionally missed filling of the shooting head as a result of a clogging in the outlet member or as a result of a malfunction of the gate is always recognized by the detection of the actual contents in the shooting head, and considered at least during renewed filling attempts.

We claim:

1. A device for filling a shooting head with molding material, the device being provided with a filling assembly that comprises a storage hopper for the molding material, an outlet member for discharging the molding material into the shooting head, and a gate for closing the outlet member, the filling assembly being mounted on a machine frame for vertical movement so as to immerse the outlet member into the shooting head that is to be filled, the device further comprising a noncontacting sensor associated with the outlet member, the sensor being directed into the shooting head so as to detect the level of the molding material therein.

2. The device as in claim 1, wherein the sensor is designed and constructed as an ultrasonic sensor.

3. The device as in claim 1, wherein the sensor is associated with the lower region of the outlet member.

4. The device as in claim 3, wherein the sensor is attached to the outside wall of the outlet member.

5. The device as in claim 1, wherein the filling of the shooting head and thus the opening and closing of the gate is controllable via a signal of the sensor.

6. The device as in claim 1, wherein at a predetermined depth of immersion of the outlet member and upon detection of the level of the molding material that is likewise predeterminable and corresponds at most to the depth of immersion, the sensor supplied a signal for closing the gate.

* * * * *